US009215767B2

(12) United States Patent
Hua et al.

(10) Patent No.: US 9,215,767 B2
(45) Date of Patent: Dec. 15, 2015

(54) DEVICE AND SYSTEM FOR LOAD DRIVING

(75) Inventors: Guichao Hua, Hangzhou (CN); Liang'an Ge, Hangzhou (CN); Hangdong Yu, Hangzhou (CN)

(73) Assignee: INVENTRONICS (HANGZHOU), INC., Hangzhou, Zhejiang (CN)

( * ) Notice: Subject to any disclaimer, the term of this patent is extended or adjusted under 35 U.S.C. 154(b) by 272 days.

(21) Appl. No.: 13/994,280

(22) PCT Filed: Aug. 23, 2011

(86) PCT No.: PCT/CN2011/078753

§ 371 (c)(1),
(2), (4) Date: Jun. 14, 2013

(87) PCT Pub. No.: WO2012/088904

PCT Pub. Date: Jul. 5, 2012

(65) Prior Publication Data

US 2013/0271032 A1 Oct. 17, 2013

(30) Foreign Application Priority Data

Dec. 27, 2010 (CN) ..... 2010 1 0607074

(51) Int. Cl.
*H05B 37/02* (2006.01)
*H05B 33/08* (2006.01)

(52) U.S. Cl.
CPC ..... *H05B 33/0815* (2013.01); *H05B 33/0827* (2013.01); *Y10T 307/406* (2015.04)

(58) Field of Classification Search
None
See application file for complete search history.

(56) References Cited

U.S. PATENT DOCUMENTS

| | | | | |
|---|---|---|---|---|
| 6,949,889 | B2 | 9/2005 | Bertrand | |
| 7,557,521 | B2 * | 7/2009 | Lys | 315/294 |
| 2005/0162096 | A1 | 7/2005 | Bertrand | |
| 2008/0122385 | A1 | 5/2008 | Dou et al. | |
| 2011/0080102 | A1 * | 4/2011 | Ge et al. | 315/200 R |

FOREIGN PATENT DOCUMENTS

| | | | |
|---|---|---|---|
| CN | 201409244 | Y | 2/2010 |
| CN | 101801136 | A | 8/2010 |

(Continued)

OTHER PUBLICATIONS

International Search Report and Written Opinion regarding PCT/CN2011/078753 dated Nov. 3, 2011. Translation provided by Unitalen Attorneys at Law.

*Primary Examiner* — Long Nguyen
(74) *Attorney, Agent, or Firm* — Harness, Dickey & Pierce, P.L.C.

(57) ABSTRACT

A device and system for load driving. The device includes: an electric energy supplying unit including at least two units with output voltage adjustable; a sampling unit, with the input thereof connected to either end of a load unit for sampling the current of that end and sending the sampled current to an output voltage controller; the output voltage controller, with the input thereof connected to the output of the sampling unit for outputting voltage control signal to each unit with output voltage adjustable, according to the sampled current, so as to control the difference between the output voltage of each unit with output voltage adjustable and the maximum load voltage in a load branch to be not greater than a preset difference threshold, with the difference threshold being greater than or equal to zero. The device and system for load driving can improve the reliability of the driving device and can reduce the complexity of the circuit.

15 Claims, 6 Drawing Sheets

(56) References Cited

FOREIGN PATENT DOCUMENTS

| | | | |
|---|---|---|---|
| CN | 101925222 A | | 12/2010 |
| CN | 201919217 | * | 8/2011 |
| CN | 201919217 U | | 8/2011 |
| CN | 102548100 A | | 7/2012 |

* cited by examiner

DEVICE AND SYSTEM FOR LOAD DRIVING

This application is a National Stage application of PCT international application PCT/CN2011/078753, filed on Aug. 23, 2011, which claims the priority of Chinese Patent Application No. 201010607074.3, entitled "LOAD DRIVING DEVICE AND LOAD DRIVING SYSTEM", filed with the Chinese Patent Office on Dec. 27, 2010, both of which are incorporated herein by reference in their entirety.

FIELD OF THE INVENTION

The invention relates to the field of circuit, and particularly to a load driving device and a load driving system.

BACKGROUND OF THE INVENTION

Most of the existing Light Emitting Diode (LED) luminaries have the structures which is designed based on the conventional gas discharge lamp and Tungsten lamp. The driving scheme which follows the conventional idea includes: providing one driver for one light source, and using a conventional AC/DC conversion technique with single-path or multi-path output. As shown in FIG. 1, a lighting device includes a light source and a driver, and is controlled by a distribution switch. As shown in FIG. 1, the driver is provided nearby the light source inside the lighting device.

Specifically, FIG. 2 shows a circuit structure of an LED lighting device. In FIG. 2, a output voltage adjustable voltage source 201 in the front-stage samples the minimum value of the drain voltages of adjustment transistors Q1~Qn in the multi-path linear adjustment current-limiting circuit 203 in the post-stage via a minimum value sampling circuit 202, and a feedback control is performed based on the minimum value by an output voltage control circuit 204. In this way, the minimum value is kept to a small value, and the output voltage Vo of the output voltage adjustable voltage source 201 is always little larger than the voltage of the LED load with the highest voltage in the multi LED loads, and thus the linear adjustment current-limiting circuit 203 always has the minimum power consumption approximately while ensuring that the constant current driving of the current limit is performed by each LED load. The driver of the lighting device includes the output voltage adjustable voltage source 201, the minimum value sampling circuit 202 and the output voltage control circuit 204; and the light source unit includes a multiple of LED compositions and a multiple of linear adjustment current-limiting circuits (a LED branch includes a LED composition and a corresponding linear adjustment current-limiting circuit).

However, the above circuit structure has the following disadvantages.

Firstly, in order to facilitate the minimum value sampling circuit of the driver to perform a voltage sampling from the post-stage circuit, the linear adjustment current-limiting circuit 203 of each LED branch often needs to be enclosed inside the driver, the loss of the adjustment transistor is large when the voltage difference between the multiple of LED branches is large, resulting in serious heat of the driver. Moreover, the driver is generally placed nearby the LED light source inside the LED lighting device, thus the temperature thereof will be higher, which affects the reliability of the driver seriously.

Secondly, the output voltage control circuit 204 of the output voltage adjustable voltage source 201 in the front-stage needs to sample the voltage of the post-stage circuit composed of a LED and the corresponding linear adjustment current-limiting circuit 203, so that the wiring between the front-stage output voltage adjustable voltage source 201 and the post-stage circuit is complicated. Moreover, when an open circuit fault occurs in a certain LED load, the drain voltage of the linear adjustment transistor is zero. Therefore, it is necessary to further provide an open circuit protection for each LED load, so as to ensure that other LED loads in which no fault occurs can operate normally in this case, which further increases the complexity of the circuit.

SUMMARY OF THE INVENTION

In view of this, an object of the invention is to provide a load driving device and a load driving system, so as to improve the reliability of the driving device and reduce the complexity of the circuit.

To this end, the following technical solution is adopted in embodiments of the invention.

A load driving device is provided according to an embodiment of the invention, and the device includes:

an electric energy supplying unit including at least two output voltage adjustable units, where a first output of each output voltage adjustable unit is connected to a first output of the electric energy supplying unit and a second output of each output voltage adjustable unit is connected to a second output of the electric energy supplying unit;

a sampling unit having an input connected to either output of the electric energy supplying unit, and adapted to sample a current from the output of the electric energy supplying unit and transmit the sampled current to an output voltage controller; and the output voltage controller having an input connected to an output of the sampling unit, and adapted to determine an output voltage control strategy for the output voltage adjustable units according to the sampled current and output a voltage control signal to each output voltage adjustable unit according to the control strategy, so as to control the difference between the output voltage of each output voltage adjustable unit and a maximum one of load voltages of post-stage load branches to be not greater than a preset difference threshold, the preset difference threshold being greater than or equal to zero.

Each output voltage adjustable unit may include:

a switch conversion main circuit adapted to perform a voltage conversion on an input voltage under the control of a voltage loop; and the voltage loop connected to two outputs of the switch conversion main circuit to sample an output voltage; and connected to an output of the output voltage controller to control an output voltage of the switch conversion main circuit according to the sampled voltage and the voltage control signal from the output voltage controller.

The output voltage adjustable unit may further include:

a current-equalizing unit connected to either output of the switch conversion main circuit, and adapted to sample a current from the output and transmit the sampled signal to an input of the voltage loop, so as to control, by the voltage loop, a variation direction of the output voltage of the switch conversion main circuit to be opposite to a variation direction of the sampled current.

The voltage loop may include:

a first resistor and a second resistor which are connected in series between the two outputs of the corresponding switch conversion main circuit, wherein a connection point between the first resistor and the second resistor is connected to an inverting input of a first operational amplifier; and the inverting input of the first operational amplifier is further connected to the output of the output voltage controller, and is connected to an output of the first operational amplifier via a compensation network;

a non-inverting input of the first operational amplifier is connected to a preset output voltage value; and the output of the first operational amplifier serves as an output of the voltage loop and is adapted to control the output voltage of the switch conversion main circuit.

The current-equalizing unit may include:

a third resistor connected in series between the output of the switch conversion main circuit and a corresponding output of the electric energy supplying unit; wherein an end of the third resistor connected to the output of the electric energy supplying unit is connected to the inverting input of the first operational amplifier via a fourth resistor.

The current-equalizing unit include:

a third resistor connected in series between the output of the switch conversion main circuit and a corresponding output of the electric energy supplying unit; wherein an end of the third resistor connected to the output of the electric energy supplying unit is connected to a non-inverting input of a second operational amplifier via a fourth resistor; an inverting input of the second operational amplifier is grounded via a fifth resistor and is connected to an output of the second operational amplifier via a sixth resistor; and wherein the output of the second operational amplifier is connected to the inverting input of the first operational amplifier.

The output voltage controller is adapted to determine an adjustment direction and a step size of the output voltage of each output voltage adjustable unit according to a variation relationship between the sampled current and the output voltage; and to adjust the amplitude of the output voltage of each output voltage adjustable unit according to the adjustment direction and the step size, so that the difference between the output voltage and the maximum one of the load voltages of the load branches is not greater than the preset difference threshold.

The output voltage controller is further adapted to determine the adjustment direction for the amplitude of the output voltage of each output voltage adjustable unit by:

in the case where the output voltage of the output voltage adjustable unit is increased by a certain step size based on a previous output voltage of the output voltage adjustable unit, estimating the variation direction of the sampled current, and determining that the output voltage is in a rising adjustment direction if the sampled current is increased as the output voltage is increased; determining that the output voltage is in a falling adjustment direction if the sampled current does not change as the output voltage is increased;

in the case where the output voltage of the output voltage adjustable unit is decreased by a certain step size based on a previous output voltage of the output voltage adjustable unit, estimating the variation direction of the sampled current, and determining that the output voltage is in a falling adjustment direction if the sampled current does not change as the output voltage is decreased; determining that the output voltage is in a rising adjustment direction if the sampled current is decreased as the output voltage is decreased.

The output of the electric energy supplying unit may be connected to a corresponding input of a load unit via a dimming switch, so as to control the average of the total current in the load unit by controlling the dimmer switch.

The electric energy supplying unit, the sampling unit and the output voltage controller may be enclosed as an assembly, and the load unit may be enclosed separately.

A fault isolation circuit is connected in series between the output of the output voltage adjustable unit and a corresponding output of the electric energy supplying unit, so as to isolate a fault when the fault occurs in the corresponding output voltage adjustable unit.

The fault isolation circuit may be adapted to isolate a fault, when the fault occurs in the corresponding output voltage adjustable unit, by: making the fault isolation circuit in a low resistive state, when the corresponding output voltage adjustable unit works normally; or making the fault isolation circuit in a high resistive state, when a fault occurs in the output voltage adjustable unit.

A load driving system is further provided according to an embodiment of the invention, and the system includes:

a load unit including at least one load branch, wherein a first end of each load branch is connected to a first end of the load unit and a second end of each load branch is connected to a second end of the load unit;

an electric energy supplying unit including at least two output voltage adjustable units, wherein a first output of each output voltage adjustable unit is connected to a first output of the electric energy supplying unit and a second output of each output voltage adjustable unit is connected to a second output of the electric energy supplying unit, the first output of the electric energy supplying unit is connected to the first end of the load unit and the second output of the electric energy supplying unit may be connected to the second end of the load unit;

a sampling unit having an input connected to either output of the electric energy supplying unit, and adapted to sample a current from the output of the electric energy supplying unit and transmit the sampled current to an output voltage controller; and the output voltage controller having an input connected to an output of the sampling unit and adapted to determine an output voltage control strategy for the output voltage adjustable unit according to the sampled current and output a voltage control signal to each output voltage adjustable unit according to the control strategy, so as to control the difference between the output voltage of each output voltage adjustable unit and the maximum one of load voltages of the load branches to be not greater than a preset difference threshold, the preset difference threshold being greater than or equal to zero.

The load branch includes a set of loads connected in series and a current-limiting circuit of the load branch.

The current-limiting circuit may include:

a first switch and a resistor connected in series, wherein two ends of the resistor are connected to two inputs of a current-limiting controller respectively, and an output of the current-limiting controller is adapted to control the switching of the first switch, so that the current in the corresponding load branch is not greater than a preset current value.

An analysis of the technical effect of the above solutions is as follows.

The electric energy supplying unit includes at least two output voltage adjustable units, and the outputs of each output voltage adjustable unit are connected in parallel, so as to achieve the capability expansion of the system and the redundant backup of electric energy supplying, and thus the reliability of the driving device is improved. Moreover, the input of the sampling unit is connected to either output of the electric energy supplying unit and is adapted to sample the total current output from the electric energy supplying unit, that is, to sample the total current in the post-stage load branches, so that the driving device and the load unit can be enclosed separately, and the set distance between the driving device and the load unit can be increased, and thus the heat source of the driving device can be reduced and the reliability of the driving device is further improved. In addition, the loss of the current-limiting circuit of the post-stage load unit is minimized by the output voltage of the output voltage adjustable unit, such that the heat of the driving device is reduced and the reliability of the load driving system is further improved.

Moreover, the electric energy transmission between the electric energy supplying unit and the load unit can be achieved by two connection wires, the wiring is simple, and thus the complexity of the circuit is reduced. Further, when the amount of the load branches is varied, for example, when a load branch is opened or another branch is added, the electric energy supplying unit can adjust the output voltage automatically by the sampling unit and the control of the output voltage controller, the constant-current driving of the other load branches is achieved, so that no open protection circuit needs to be provided for each load branch separately, thus the complexity of the circuit is further reduced and the cost is saved.

DETAILED DESCRIPTION OF THE INVENTION

Figure 1:
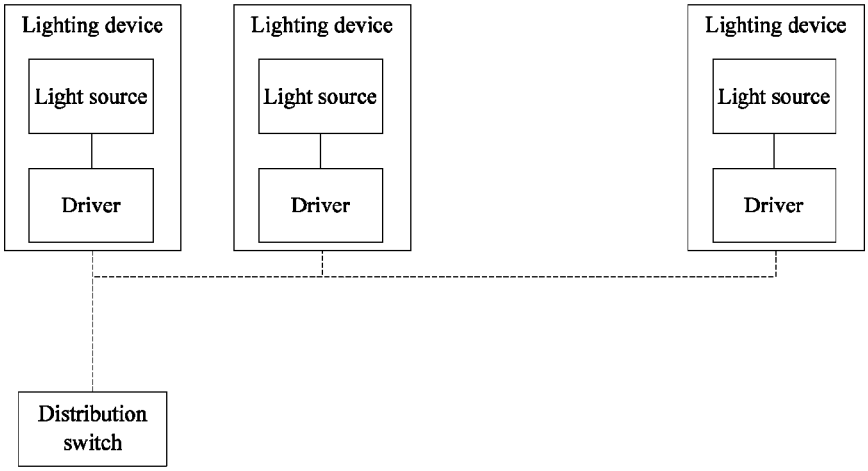
FIG. 1 is a schematic structural diagram of a lighting device in the prior art.
Figure 2:
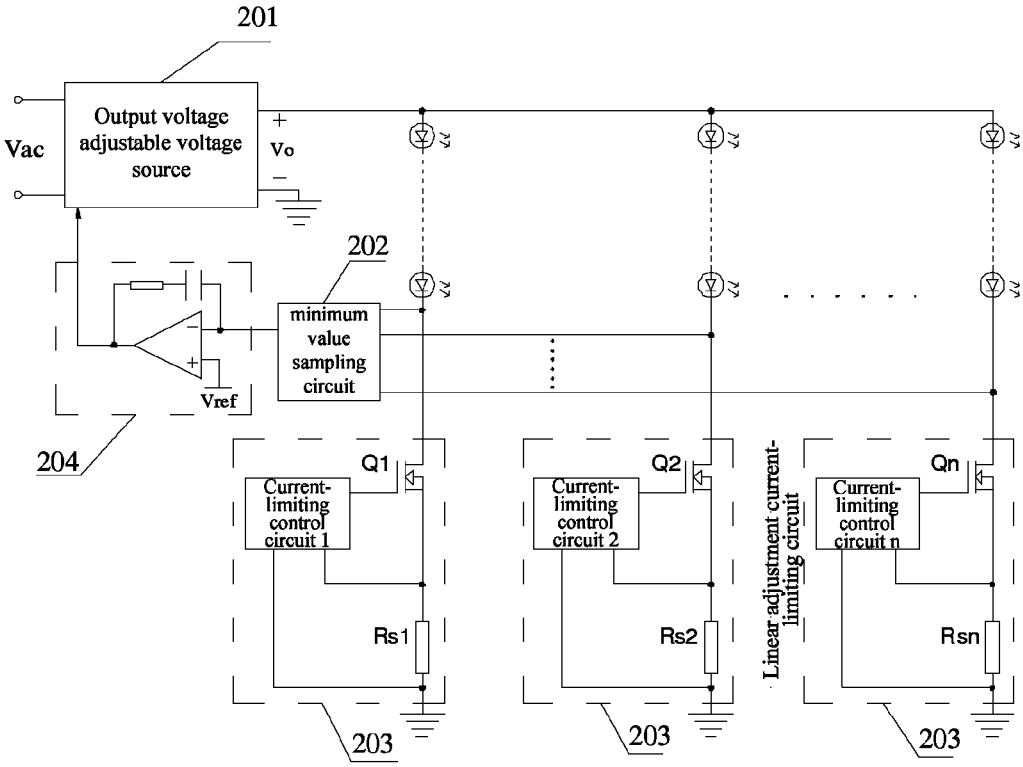
FIG. 2 is a schematic structural diagram of a specific circuit of a LED lighting device in the prior art.

Specific implementations of a load driving system according to an embodiment of the invention will be described in detail in conjunction with the drawings hereinafter.

A load driving system according to an embodiment of the invention includes:

a load unit including at least one load branch, in which a first end of each load branch is connected to a first end of the load unit and a second end of each load branch is connected to a second end of the load unit;

an electric energy supplying unit including at least two output voltage adjustable units, in which a first output of each output voltage adjustable unit is connected to a first output of the electric energy supplying unit and a second output of each output voltage adjustable unit is connected to a second output of the electric energy supplying unit, the first output of the electric energy supplying unit is connected to the first end of the load unit and the second output of the electric energy supplying unit is connected to the second end of the load unit;

a sampling unit having an input connected to either output of the electric energy supplying unit, and adapted to sample a current from the output of the electric energy supplying unit and transmit the sampled current to an output voltage controller; and the output voltage controller having an input connected to an output of the sampling unit, and adapted to determine an output voltage control strategy for the output voltage adjustable unit according to the sampled current and output a voltage control signal to each output voltage adjustable unit according to the control strategy, so as to control the difference between the output voltage of each output voltage adjustable unit and the maximum one of load voltages of the load branches in the post-stage to be not greater than a preset difference threshold, the preset difference threshold being greater than or equal to zero.

The electric energy supplying unit, the sampling unit and the output voltage controller compose the load driving device for driving the load unit according to the embodiment of the invention, and the load driving device together with the load units in the post-stage composes the load driving system according to the embodiment of the invention.

In the load diving device and the load diving system as stated above, the electric energy supplying unit includes at least two output voltage adjustable units. The outputs of output voltage adjustable units are connected in parallel, so as to extend the system and achieve the redundant backup of electric energy supplying, and thus the reliability of the driving device is improved. Moreover, an input of the sampling unit is connected to either output of the electric energy supplying unit, so as to sample the current for the total current of the load branches, rather than sample each load branch. In this way, the load unit and the driving device can be enclosed separately, and the set distance between the driving device and the load unit can be increased, and thus the heat sources of the driving device are reduced and the reliability of the driving device is further improved. Furthermore, the current-limiting circuit can be provided in the load plate of the load branches in which the current-limiting circuit is located, so that the heat dissipation of the current-limiting circuit can be easier, and the reliability of the current-limiting circuit is improved. In addition, the loss of the current-limiting circuit of the load unit in the post-stage is minimized by the output voltage of the output voltage adjustable unit, so as to reduce the heat of the driving device and further improve the reliability of the load driving system.

Moreover, the electric energy transmission between the electric energy supplying unit and the load unit can be achieved by two connection wires therebetween, the wiring is simple, and thus the complexity of the circuit is reduced. Further, when the amount of the load branches is varied, for example, when a load branch is opened or another branch is added, the electric energy supplying unit can automatically adjust the output voltage via the sampling unit and the control of the output voltage controller, so as to achieve the constant-current driving of the other load branches. In this way, no open protection circuit needs to be provided for each load branch separately, and thus the complexity of the circuit is reduced further and the cost is saved.

The electric energy supplying unit, the sampling unit and the output voltage controller can be enclosed as an assembly, serving as the driving device for driving the load unit, and the load unit may be provided separately. Additionally, the driving device can also be an assembly enclosing the sampling unit and the output voltage controller, and each output voltage adjustable unit of the electric energy supplying unit can be modularized or provided separately. A fault output voltage adjustable unit can be replaced easier. Additionally, the load unit can also be enclosed as one or more units as required, which is not defined here. For example, several load branches form one unit, and the other load branches form the other unit. Alternatively, all the load branches can also be enclosed into one unit.

Here, the load units are controlled by the driving device centralizedly, the complexity of the circuit of the load driving system is reduced, and the implementation cost of the system is reduced. Further, since the driving device and the load unit are enclosed respectively, the driving device does not need to be approximated to the load unit, so that the temperature of the driving device is decreased, the reliability of the driving device is improved, and the reliability of the load driving system is improved.

In a lighting system, the above driving device and the separately enclosed load unit correspond to the driver for driving the light source and the light source unit respectively. In the lighting system, the enclosed unit also is a light source unit. Those light source units are controlled by the driver centralizedly, and the complexity of the circuit of the lighting system is reduced, and thus the implementation cost of the system is reduced. Further, since the driver and the light source unit are enclosed respectively, the driver does not need to be approximated to the light source unit, so that the temperature of the driver is decreased, the reliability of the driver is improved, and the reliability of the lighting system is improved.

Hereinafter, the implementation of the load driving device and system according to the embodiment of the invention will be described in more detail in conjunction with the embodiments.

Figure 3:
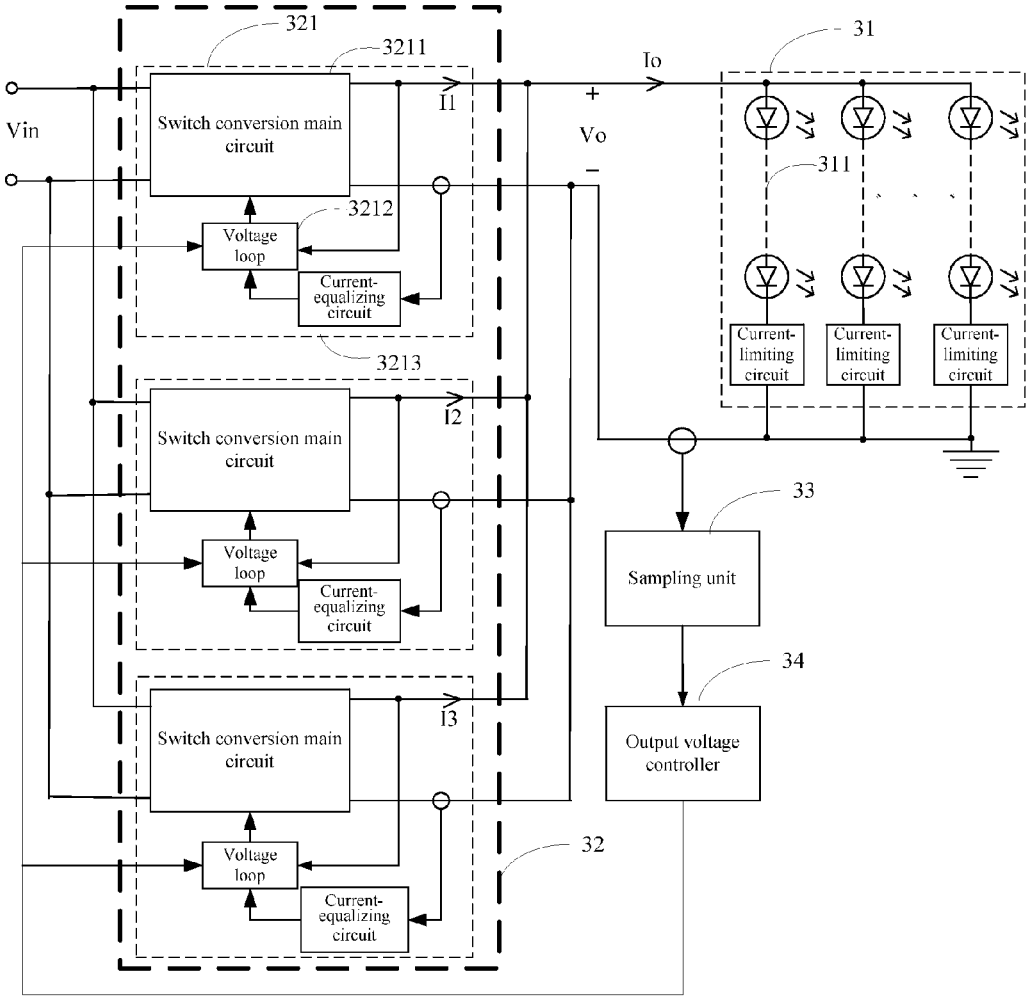
FIG. 3 is a schematic structural diagram of a load driving system according to an embodiment of the invention.

FIG. 3 is a schematic structural diagram of a load driving system according to an embodiment of the invention. As shown in FIG. 3, the system includes a load unit 31, an electric energy supplying unit 32, a sampling unit 33 and an output voltage controller 34.

The load unit 31 includes at least one load branch 311. A first end of each load branch 311 is connected to a first end of the load unit 31 and a second end of each load branch 311 is connected to a second end of the load unit 31, that is, the load branches are connected in parallel. Each load branch 311 includes a group of light sources connected in series and a corresponding current-limiting circuit. The group of light sources includes several light sources connected in series, such as LED lamps.

The electric energy supplying unit 32 includes at least two output voltage adjustable units 321. A first output of each output voltage adjustable units 321 is connected to a first output of the electric energy supplying unit 32 and a second output of each output voltage adjustable units 321 is connected to a second output of the electric energy supplying unit 32. The first output of the electric energy supplying unit 32 is connected to the first end of the load unit 31, and the second output of the electric energy supplying unit 32 is connected to the second end of the load unit 31.

The electric energy supplying unit includes at least two output voltage adjustable units. When faults occur in partial output voltage adjustable units, the other output voltage adjustable units can output currents normally, and can still provide the required rated current for the load. In this way, the electric energy supplying unit has a redundant backup capacity, and the reliability of the driving device in a load driving system is improved.

The sampling unit 33 has an input connected to either output of the electric energy supplying unit 32, and is adapted to sample a current from the output of the electric energy and transmit the sampled current to an output voltage controller 34. Here, the sampled current not only can be a total current outputted from all output voltage adjustable units, but also can be an average of currents outputted from all output voltage adjustable units.

The output voltage controller 34 has an input connected to an output of the sampling unit 34 and an output connected to one input of each output voltage adjustable unit 321, and is adapted to determine an output voltage control strategy for the output voltage adjustable unit 321 according to the sampled current and output a voltage control signal to each output voltage adjustable unit 321 according to the control strategy, so as to control the difference between the output voltage of each output voltage adjustable unit and the maximum one of load voltages of the load branches to be not greater than a preset difference threshold, where the preset difference threshold is greater than or equal to zero.

Specifically, the output voltage controller is implemented in a digital control method. When the outputted total current is sampled, the specific operating process of adjusting each output voltage can include:

determining an adjustment direction and a step size of the output voltage of the output voltage adjustable unit according to a variation relationship between the sampled current and the output voltage; and adjusting the amplitude of the output voltage of each output voltage adjustable unit according to the adjustment direction and the step size, so that the difference between the output voltage and the maximum one of the load voltages of the load branches is not greater than the preset difference threshold.

The specific implementation of the above process can include the following steps:

Firstly, determining the adjustment direction of the output voltage of the output voltage adjustable unit according to the variation relationship between the sampled current and the output voltage, that is:

(1) in the case where the output voltage of the output voltage adjustable unit is increased by a certain step size based on a previous output voltage of the output voltage adjustable unit, estimating the variation direction of the sampled current, and determining that the output voltage is in a rising adjustment direction if the sampled current increases as the output voltage increases; determining that the output voltage is in a falling adjustment direction if the sampled current does not change as the output voltage increases; and (2) in the case where the output voltage of the output voltage adjustable unit is decreased by a certain step size based on a previous output voltage of the output voltage adjustable unit, estimating the variation direction of the sampled current, and determining that the output voltage is in a falling adjustment direction if the sampled current does not change as the output voltage drops; determining that the output voltage is in a rising adjustment direction if the sampled current drops as the output voltage drops.

Secondly, adjusting the amplitude of the output voltage of the output voltage adjustable unit by a preset step size according to the adjustment direction of the output voltage.

The output voltage can be adjusted once by the above steps or can be adjusted by repeating the above steps, so that the difference between the output voltage and the maximum one of the load voltages of the load branches is not greater than the preset difference threshold.

The described-above load voltage refers to the voltage between the two ends of the set of loads connected in series in the load branches.

Preferably, as shown in FIG. 3, the output voltage adjustable unit 321 can include:

a switch conversion main circuit 3211 adapted to perform a voltage conversion on an input voltage under the control of a voltage loop; and the voltage loop 3212 connected to two outputs of the switch conversion main circuit to sample an output voltage of the switch conversion main circuit; and connected to the output of the output voltage controller 34 to control the output voltage of the switch conversion main circuit 3211 according to the sampled voltage and the control signal from the output voltage controller.

Additionally, the output voltage adjustable unit 321 can further include:

a current-equalizing unit 3213 connected to either output of the switch conversion main circuit 3211 and adapted to sample a current from the output of the switch conversion main circuit 3211 and transmit the sampled signal to an input of the voltage loop 3212, so as to control, by the voltage loop 3212, a variation direction of the output voltage of the switch conversion main circuit 3211 to be opposite to a variation direction of the sampled current.

The current-equalizing unit controls the output voltage of the switch conversion main circuit via the voltage loop to share the current outputted from the output voltage adjustable unit. When each output voltage adjustable unit in the electric energy supplying unit works normally or when faults occur in partial output voltage adjustable units, there may be differences among the output voltages. Even small voltage difference may cause imbalance of the currents of the output voltage adjustable units. The function of the current-equalizing circuit is to achieve the balanced distribution of the output currents among multiple output voltage adjustable units.

Additionally, the load branch can include a set of loads connected in series and a corresponding current-limiting circuit.

The set of loads connected in series can be multiple LED lamps connected in series in the background, and can also be other direct current load similar to LED, which is not limited here.

Figure 4:
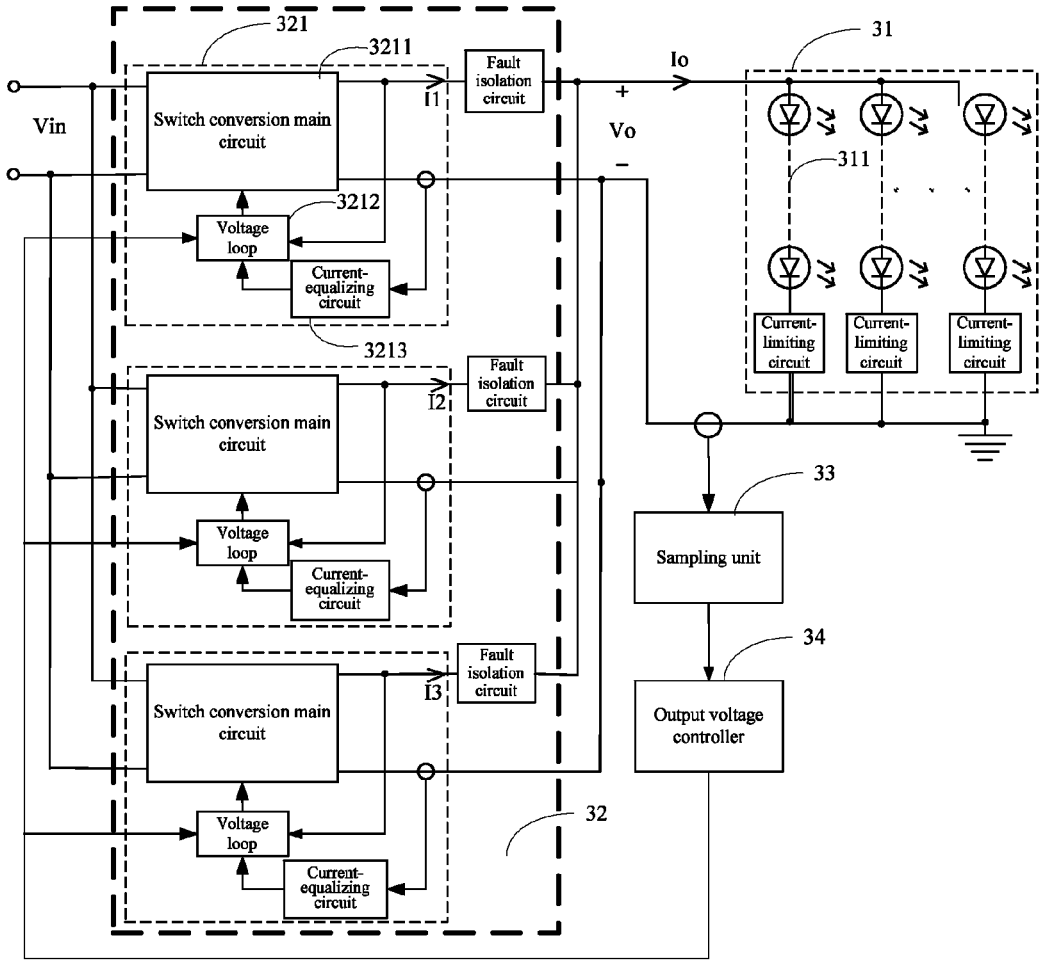
FIG. 4 is a schematic structural diagram of another load driving system according to an embodiment of the invention.

Preferably, in order to achieve the function of redundancy backup, that is, the other output voltage adjustable units can still meet the requirement of the load in the case that faults occur in one or more output voltage adjustable units, a fault isolation circuit needs to be connected in series between the output of each output voltage adjustable unit and the corresponding output of the electric energy supplying unit, as shown in FIG. 4. The fault isolation circuit can be a diode, and can also be a unidirectional switch transistor (such as an MOS transistor) under the control of a fault signal, or other switching device, such as a relay. Further the fault isolation circuit can also be a device, such as a fuse. For example, in the case that the fault isolation circuit is a fuse or relay, when the corresponding output voltage adjustable unit works normally, the fault isolation circuit exhibits a low resistive state; and when a fault occurs in the corresponding output voltage adjustable unit, the fault isolation circuit exhibits a high resistive state. In the case that the fault isolation circuit is an MOS transistor, the direction of the body diode of the MOS transistor is the same as that of the output current of the corresponding output voltage adjustable unit. Thus, when the corresponding output voltage adjustable unit works normally, the MOS transistor is turn-on (corresponding to the low resistive state); and when a fault occurs in the corresponding output voltage adjustable unit, the MOS transistor is turn-off (corresponding to the high resistive state). In the case where the fault isolation circuit is a diode, the direction of the diode is the same as that of the output current of the corresponding output voltage adjustable unit. Each fault isolation circuit can be enclosed with the corresponding output voltage adjustable unit, and can also be a module enclosed separately.

Figure 5:
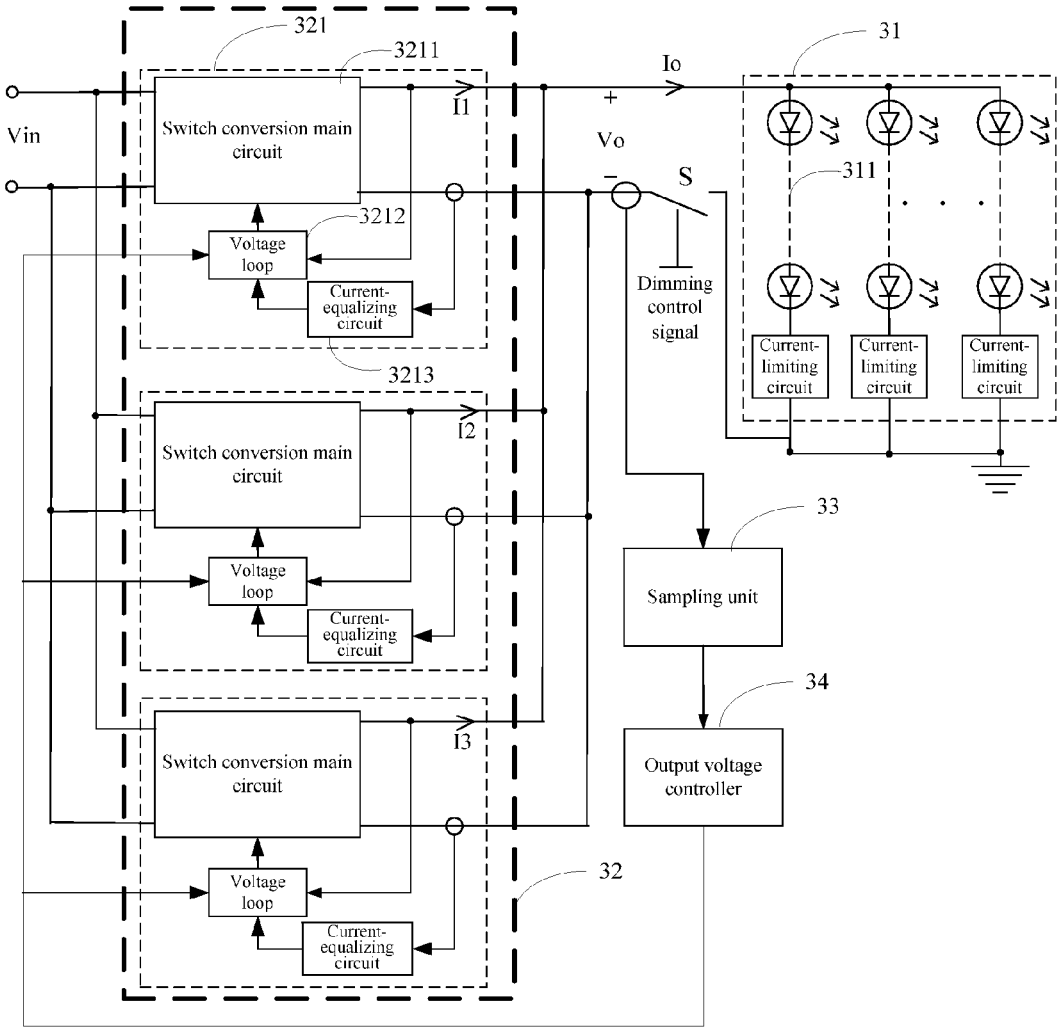
FIG. 5 is a schematic structural diagram of yet another load driving system according to an embodiment of the invention.

In the case that the load is an LED load, as shown in FIG. 5, the output of the electric energy supplying unit 320 can be connected to a corresponding input of the load unit 310 via a dimming switch S. When a dimming control signal controls the dimming switch S to be turn-on, the LED load obtains a current from the electric energy supplying unit in the front-stage; and when the dimming control signal controls the dimming switch S to be turn-off, there is no current in the LED load, and the average of the total current of the LED load in the post-stage can be changed by changing the duty cycle of the dimming switch S, so as to achieve the dimming of the LED load.

Hereinafter, the specific implementation of each unit is described in detail.

The switch conversion main circuit can be an AC-DC converter or a DC-DC converter, that is, an input voltage Vin of the switch conversion main circuit can be an alternating-current voltage or a direct-current voltage, which is not limited here.

Figure 6:
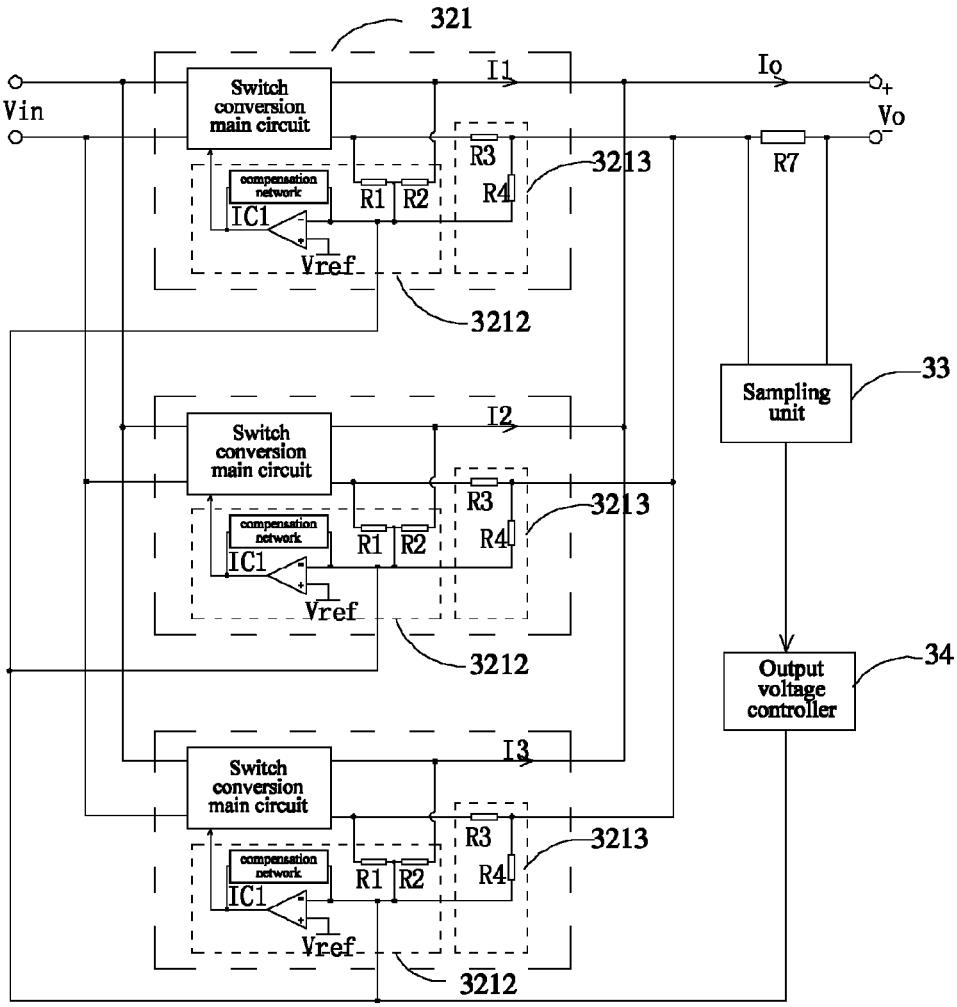
FIG. 6 shows an exemplary circuit of a specific implementation of each component of a load driving system according to an embodiment of the invention.

As shown in FIG. 6, the voltage loop 3212 can include a first resistor R1 and a second resistor R2 connected in series between the two outputs of the corresponding switch conversion main circuit 3211. A connection point between the first resistor R1 and the second resistor R2 is connected to an inverting input of a first operational amplifier IC1. The inverting input of the first operational amplifier is connected to the output of the output voltage controller 34, and is connected to the output of the first operational amplifier IC1 via a compensation network. A non-inverting input of the first operational amplifier IC1 is connected to a preset output voltage Vref. An output of the first operational amplifier IC1 is the output of the voltage loop 3212. The output voltage of the switch conversion main circuit 3211 is the preset output voltage Vref. The compensation network can be anyone compensation network of a closed-loop control circuit, so as to achieve the closed-loop control of the voltage loop 3212 and the closed-loop adjustment of the output voltage.

The voltage control signal outputted from the output voltage controller 34 is superimposed with the sampled signal of the output voltage at the connection point between the first resistor R1 and the second resistor R2, as a feedback signal which is input to an inverting input of the voltage loop 3212. The feedback signal is compared with a reference voltage signal of the non-inverting input of the voltage loop 3212, and then the output voltage of the switch conversion main circuit 3211 is adjusted by the voltage loop 3212, so as to control the amplitude of the output voltage of the switch conversion main circuit 3211.

The current-equalizing unit can include a third resistor R3 connected in series between the output of the switch conversion main circuit 3211 and a corresponding output of the electric energy supplying unit 32. An end of the third resistor R3 connected to the output of the electric energy supplying unit 32 is connected to the inverting input of the first operational amplifier IC1 via a fourth resistor R4.

By those connections, the output current 11 of the switch conversion main circuit is sampled by the current-equalizing unit, and is input directly to the inverting input of the first operational amplifier IC1 in the voltage loop via the fourth resistor, so that the output voltage of the switch conversion main circuit is decreased as the output current I1 is increased, or increased as the current I1 is decreased.

Figure 7:
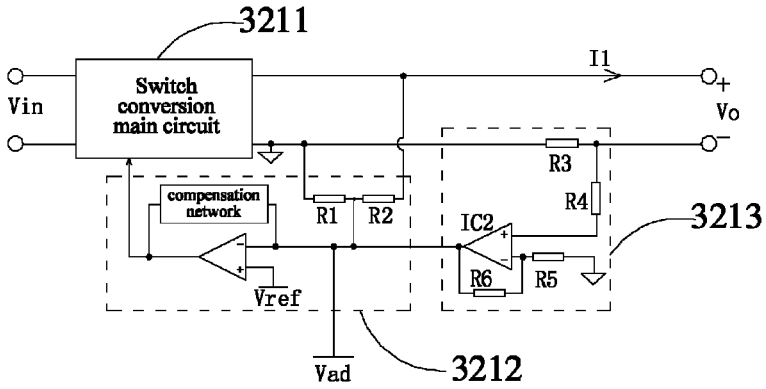
FIG. 7 is a schematic structural diagram of another implementation of a current-equalizing circuit according to an embodiment of the invention.

However, the current I1 sampled by the current-equalizing unit via the third resistor R3 is generally small, and can not be input directly to the voltage loop for controlling the output voltage. In this case, the sampled current can be amplified before it is transmitted to the inverting input of the first operational amplifier IC. As shown in FIG. 7, the fourth resistor R4 is connected to a non-inverting input of a second operational amplifier IC2. An inverting input of the second operational amplifier IC2 is connected to ground via a fifth resistor R5, and is also connected to an output of the second operational amplifier IC2 via a sixth resistor. The output of the second operational amplifier IC2 is connected to the inverting input of the first operational amplifier IC1.

The resistances of the fifth resistor R5 and the sixth resistor R6 depend on the multiple by which the sampled current needs to be amplified, and can be set independently in the practical application, which is not described here.

Figure 8:
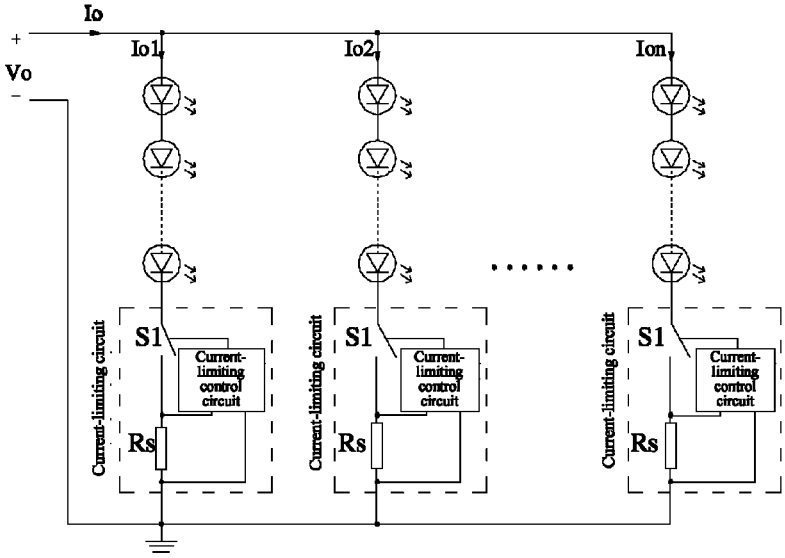
FIG. 8 is a schematic structural diagram of an implementation of current-limiting circuits in load branches according to an embodiment of the invention.

FIG. 8 shows an exemplary implementation of a current-limiting circuit in a load branch. The current-limiting circuit can be a linear adjustment circuit. Specifically, each current-limiting circuit includes a first switch S1 and a resistor Rs connected in series, two ends of the resistor Rs are connected to two inputs of a current-limiting controller respectively, and an output of the current-limiting controller is adapted to control the switching of the first switch S1, so that the current in the corresponding load branch is not greater than the preset current value, to achieve the current limitation for the load branch. The first switch can be implemented by an adjustment transistor. When the adjustment transistor works in a linear state, the current in the load branch is a direct current; and when the adjustment transistor works in a switching state or full-on state, the current in the load branch is a pulse chopping current (such as the PWM current) or a direct current.

Alternatively, the current-limiting circuit can also be implemented by a constant current diode.

In the above load driving system according to the embodiment of the invention, an output voltage of each output voltage adjustable unit can be adjusted adaptively by the output voltage controller according to a variation in the total current outputted from the electric energy supplying unit, and the output voltage can also be adjusted by the current-equalizing circuit itself in the output voltage adjustable unit. In the invention, the output voltage of the output voltage adjustable unit is decreased as the output current is increased by using the current-equalizing circuit, so as to achieve current sharing among multiple output voltage adjustable units. According to the solution, the dynamic response is fast, and thus the adaptive adjustment process of the output voltage is not affected. Further, maximum or average current-equalizing methods can also be employed by the current-equalizing circuit, in which the output voltage is adjusted via current-equalizing loop.

These described above are only the preferable embodiments of the invention, and it should be noted that many modifications and variations can be made by those ordinary skilled in the art without deviating from the principle of the invention, which should also be considered as within the scope of protection of the invention.

What is claimed is:

1. A load driving device, comprising:

an electric energy supplying unit comprising at least two output voltage adjustable units, wherein a first output of each output voltage adjustable unit is connected to a first output of the electric energy supplying unit and a second output of each output voltage adjustable unit is connected to a second output of the electric energy supplying unit;

a sampling unit having an input connected to either output of the electric energy supplying unit, and adapted to sample a current from the output of the electric energy supplying unit and transmit the sampled current to an output voltage controller; and the output voltage controller having an input connected to an output of the sampling unit, and adapted to determine an output voltage control strategy for the output voltage adjustable units according to the sampled current and output a voltage control signal to each output voltage adjustable unit according to the control strategy, so as to control a difference between an output voltage of each output voltage adjustable unit and a maximum load voltage of load branches in a post-stage to be not greater than a preset difference threshold, the preset difference threshold being greater than or equal to zero.

2. The device according to claim 1, wherein each output voltage adjustable unit comprises:

a switch conversion main circuit adapted to perform a voltage conversion on an input voltage under the control of a voltage loop; and the voltage loop connected to two outputs of the switch conversion main circuit to sample an output voltage of the switch conversion main circuit; and connected to the output voltage controller to control an output voltage of the switch conversion main circuit according to the sampled output voltage and the voltage control signal from the output voltage controller.

3. The device according to claim 2, wherein each output voltage adjustable unit further comprises:

a current-equalizing unit connected to either output of the switch conversion main circuit and adapted to sample a current from the output of the switch conversion main circuit and transmit the sampled current to an input of the voltage loop, so as to control, by the voltage loop, a variation direction of the output voltage of the switch conversion main circuit to be opposite to a variation direction of the sampled current.

4. The device according to claim 3, wherein the voltage loop comprises:

a first resistor and a second resistor that are connected in series between the two outputs of the switch conversion main circuit, wherein a connection point between the first resistor and the second resistor is connected to an inverting input of a first operational amplifier; and the inverting input of the first operational amplifier is connected to the output of the output voltage controller, and is connected to an output of the first operational amplifier via a compensation network;

a non-inverting input of the first operational amplifier is connected to a preset output voltage; and the output of the first operational amplifier serves as an output of the voltage loop and is adapted to control the output voltage of the switch conversion main circuit.

5. The device according to claim 4, wherein the current-equalizing unit comprises:

a third resistor connected in series between the output of the switch conversion main circuit and a corresponding output of the electric energy supplying unit, wherein an end of the third resistor connected to the output of the electric energy supplying unit is connected to the inverting input of the first operational amplifier via a fourth resistor.

6. The device according to claim 4, wherein the current-equalizing unit comprises:

a third resistor connected in series between the output of the switch conversion main circuit and a corresponding output of the electric energy supplying unit, wherein an end of the third resistor connected to the output of the electric energy supplying unit is connected to a non-inverting input of a second operational amplifier via a fourth resistor; an inverting input of the second operational amplifier is grounded via a fifth resistor and is connected to an output of the second operational amplifier via a sixth resistor; and the output of the second operational amplifier is connected to the inverting input of the first operational amplifier.

7. The device according to claim 1, wherein the output voltage controller is adapted to:

determine an adjustment direction and a step size of the output voltage of each output voltage adjustable unit according to a variation relationship between the sampled current and the output voltage; and adjust an amplitude of the output voltage of each output voltage adjustable unit according to the adjustment direction and the step size, so that the difference between the output voltage and the maximum load voltage of the load branches is not greater than the preset difference threshold.

8. The device according to claim 7, wherein the output voltage controller is adapted to determine the adjustment direction of the amplitude of the output voltage of each output voltage adjustable unit by:

in response to the output voltage of the output voltage adjustable unit being increased by a certain step size based on a previous output voltage of the output voltage adjustable unit, (i) estimating a variation direction of the sampled current; (ii) determining that the output voltage is in a rising adjustment direction if the sampled current is increased as the output voltage is increased; and (iii) determining that the output voltage is in a falling adjustment direction if the sampled current does not change as the output voltage is increased; and in response to the output voltage of the output voltage adjustable unit being decreased by a certain step size based on a previous output voltage of the output voltage adjustable unit, (i) estimating the variation direction of the sampled current; (ii) determining that the output voltage is in a falling adjustment direction if the sampled current does not change as the output voltage is decreased; and (iii) determining that the output voltage is in a rising adjustment direction if the sampled current is decreased as the output voltage is decreased.

9. The device according to claim 1, wherein the output of the electric energy supplying unit is connected to a corresponding input of a load unit via a dimming switch, so as to control an average of a total current in the load unit by controlling the dimming switch.

10. The device according to claim 1, wherein the electric energy supplying unit, the sampling unit and the output voltage controller are enclosed as an assembly, and a load unit is enclosed separately.

11. The device according to claim 1, further comprising a fault isolation circuit connected in series between the first output of a first output voltage adjustable unit of the output voltage adjustable units and a corresponding output of the electric energy supplying unit, so as to isolate a fault when the fault occurs in the first output voltage adjustable unit.

12. The device according to claim 11, wherein the fault isolation circuit is adapted to isolate the fault when the fault occurs in the first output voltage adjustable unit, by:

making the fault isolation circuit in a low resistive state, when the first output voltage adjustable unit works normally; and making the fault isolation circuit in a high resistive state, when the fault occurs in the first output voltage adjustable unit.

13. A load driving system, comprising:

a load unit comprising at least one load branch, wherein a first end of each load branch is connected to a first end of the load unit and a second end of each load branch is connected to a second end of the load unit;

an electric energy supplying unit comprising at least two output voltage adjustable unit, wherein a first output of each output voltage adjustable unit is connected to a first output of the electric energy supplying unit and a second output of each output voltage adjustable unit is connected to a second output of the electric energy supplying unit, the first output of the electric energy supplying unit is connected to the first end of the load unit and the second output of the electric energy supplying unit is connected to the second end of the load unit;

a sampling unit having an input connected to either output of the electric energy supplying unit, and adapted to sample a current from the output the electric energy supplying unit and transmit the sampled current to an output voltage controller; and the output voltage controller having an input connected to an output of the sampling unit, and adapted to determine an output voltage control strategy for the output voltage adjustable unit according to the sampled current and output a voltage control signal to each output voltage adjustable unit according to the control strategy, so as to control the difference between an output voltage of each output voltage adjustable unit and a maximum load voltage of the at least one load branch to be not greater than a preset difference threshold, the preset difference threshold being greater than or equal to zero.

14. The system according to claim 13, wherein the at least one load branch comprises a set of loads connected in series and a current-limiting circuit of the at least one load branch.

15. The system according to claim 14, wherein the current-limiting circuit comprises:

a first switch and a resistor connected in series, wherein two ends of the resistor are connected to two inputs of a current-limiting controller respectively, and an output of the current-limiting controller is adapted to control the switching of the first switch, so that the current in the corresponding load branch is not greater than a preset current value.

* * * * *